US005996580A

United States Patent [19]

Swann

[11] Patent Number: 5,996,580

[45] Date of Patent: Dec. 7, 1999

[54] PERSONAL EMERGENCY BREATHING SYSTEM WITH LOCATOR FOR SUPPLIED AIR RESPIRATORS AND SHOCK RESISTANT FILTER MOUNTING

[75] Inventor: Linsey J. Swann, Vancouver, Canada

[73] Assignee: Brookdale International Systems, Inc., Vancouver, Canada

[21] Appl. No.: 09/003,357

[22] Filed: Jan. 6, 1998

[51] Int. Cl.[6] ..... A62B 7/00

[52] U.S. Cl. ..... 128/206.17; 128/205.27; 128/205.23; 128/205.16; 128/204.27; 128/204.18

[58] Field of Search ..... 128/206.18, 206.17, 128/205.12, 205.13, 205.16, 205.23, 205.25, 205.27, 204.27, 204.18, 202.27

[56] References Cited

U.S. PATENT DOCUMENTS

| | | | |
|---|---|---|---|
| 3,486,730 | 12/1969 | Potash | 128/202.27 |
| 3,651,974 | 3/1972 | Barry et al. | 220/1.5 |
| 4,997,217 | 3/1991 | Kunze | 128/912 |
| 5,186,165 | 2/1993 | Swann . | |
| 5,271,390 | 12/1993 | Gray et al. | 128/202.27 |
| 5,394,867 | 3/1995 | Swann | 128/201.28 |
| 5,524,616 | 6/1996 | Smith et al. | 128/205.27 |
| 5,562,092 | 10/1996 | George . | |
| 5,640,952 | 6/1997 | Swann et al. . | |

*Primary Examiner*—Aaron J. Lewis
*Assistant Examiner*—Todd Martin
*Attorney, Agent, or Firm*—Nixon & Vanderhye

[57] ABSTRACT

An air filtration unit is carried within a closed canister whereby upon removal of the cover, ambient air may be filtered through the filtration unit and supplied to a user. In one form, the canister is applied to a fitting of a fireman's gas mask or hose portion of the fireman's supplied air respiratory system such that in the event of system failure or exhaustion of the supplied air, the supplied air system can be disconnected and the canister applied to the gas mask or air hose fitting. A locator in the form of an apertured nose cone is projected under spring bias from the canister body to guide the canister into securement with the face mask or hose fitting. The filtration unit is also provided in the canister with shock-resistant mountings. In another form, the canister is provided with a mouthpiece, a plenum having inhalation and exhalation valves, and a hood. By removing the cover, the individual may don the hood and inhale filtered ambient air through the mouthpiece with exhaled air flowing into the hood and about an escape path defined between the hood and the user's neck.

19 Claims, 13 Drawing Sheets

PERSONAL EMERGENCY BREATHING SYSTEM WITH LOCATOR FOR SUPPLIED AIR RESPIRATORS AND SHOCK RESISTANT FILTER MOUNTING

TECHNICAL FIELD

The present invention relates to an emergency personal breathing system for use with supplied air respirators of the type having a face mask and an air supply for supplying respiratory air to the user and particularly relates to a canister containing filter material and having a unique locator mounted on the canister for facilitating accurate guided quick connection between the canister and the face mask to enable filtered ambient air to be supplied to the user in the event the supply of respiratory air is exhausted or cannot otherwise be provided to the user. The present invention also relates to a shock-resistant mounting for retaining the filtration unit within the canister without deterioration or otherwise inhibiting the effectiveness of the filtration material.

BACKGROUND

In my prior U.S. Pat. No. 5,640,952, the disclosure of which is incorporated herein by reference, there is disclosed a personal emergency breathing system for supplied air respirators. That system includes a canister closed at one end by a closure or cover and containing a filtration unit for filtering ambient air flowing through the canister. The canister includes a coupling for securing the canister to a face mask or an air supply line attached to the face mask and which face mask or supply line form part of a supplied air respirator. Typically, a supplied air respirator employs a face mask coupled to a supply of air, i.e., an air tank. The user, for example, a fireman, can thus breathe air supplied from the air tank when in an oxygen-deficient environment, for example, in a smoke or toxic fume-filled area. As set forth in my prior patent, the user of the supplied air respirator may unexpectedly encounter a malfunction of the supplied air respirator or the air supply may become exhausted at a time when the user is not able to leave the oxygen-deficient area. By immediately detaching the supplied air hose and regulator fitting from the face mask and attaching the canister to the face mask or to a portion of the supplied air hose attached to the face mask, the user is able to breathe filtered ambient air for a limited period of time, for example, on the order of about fifteen-twenty minutes. Under those circumstances, the user has that additional, though limited, time available to egress the toxic fume-filled area.

Not infrequently, however, after detaching the supplied air hose from the face mask or a portion of the supplied air hose, the user of the supplied air respirator has difficulty in attaching the canister to the face mask or the supplied air hose portion. When the canister is to be attached directly to the face mask, the canister may be out of the line of sight of the user, requiring the user to secure the canister essentially by feel, i.e., feeling the parts of the canister and face mask and manipulating them sight unseen to effect the connection. Even if the canister is to be attached to a portion of the supplied air hose in the user's line of sight, smoke-filled environments, for example, can prevent the user from observing the intended connection, thus delaying and possibly preventing the connection of the canister to the face mask or hose portion. In the event of a malfunction of the supplied air respirator or complete exhaustion of the supplied air, the user has only a very few seconds in which to effect the connection between the canister and the face mask or supplied air hose portion before being overwhelmed by toxic fumes. Thus, it has been found desirable to provide a locator on the canister for guiding the canister into quick securement with the fitting on the face mask or a supplied air hose portion of the supplied air respiratory system.

It has also been found with the foregoing-described system, as well as in the more general system set forth in my prior U.S. Pat. No. 5,315,987, the disclosure of which is incorporated by reference, that rough handling or vibration of the canister may have a significant effect on the filter materials of the filtration unit. In one form of filtration unit, the filter material is disposed in layers within the unit and preferably comprises a layer each of activated charcoal granules, a desiccant and a catalyst for catalyzation of carbon monoxide to carbon dioxide, each layer being separated by a fine fabric filter for collecting dust and particulate matter. Also, a layer of lithium peroxide or other suitable chemical may comprise a fourth layer of filter material for converting carbon dioxide to oxygen. In an alternative form, a ceramic monolithic catalytic filter may be provided. Rough handling, vibration or other quick displacements of the canister can introduce gravitational or inertial forces of sufficient magnitude to cause damage to the filtration material. For example, the ceramic substrate may crack or crumble or the filtration materials may start to move within the unit. Deterioration of the filtration granules, break through or channeling of air passages through the filtration material can decrease the effectiveness of the filtration. Consequently, it has been found desirable to shock-mount the filtration unit relative to the canister to minimize or eliminate those deleterious effects on the filtration materials.

DISCLOSURE OF THE INVENTION

In accordance with the present invention, there is provided in one aspect a personal emergency breathing system for use with a supplied air respirator of the type employing a face mask coupled to a supply of air, wherein, should the air supply become exhausted or the system malfunction, a canister containing the filter material can be immediately guided into securement with a fitting on the face mask or a supplied air hose portion of the respiratory system, enabling the user to effect the connection under adverse environmental conditions without viewing the fitting or canister. To accomplish the foregoing, the present invention provides a canister containing a filtration unit, together with a quick connect fitting and a locator at one end of the canister, both of which are normally housed within the canister when closed by the canister cover. The canister fitting may comprise a collar at one end of the canister body compatible, after the cover is removed from the face mask, for quick connection to a fitting on the gas mask. Flexible resilient lugs are provided about the canister collar to secure the collar to the face mask fitting once the canister and face mask fitting are accurately centered and seated relative to one another.

To facilitate quick securement between the fitting on the canister and the face mask or hose portion thereof, a locator is provided in the canister for guiding the canister toward securement with the fitting of the face mask or supplied air hose portion. The locator preferably comprises a tapered apertured nose cone on the end of the canister interior of the collar. The apertures of the tapered nose cone form part of the filtered ambient air flow path from the canister to the face mask or supplied air hose portion. To render the canister compact, the locator is preferably spring-biased between a recessed non-use position within the canister body when the canister is closed and a second projecting position from the end of the canister once the canister cover has been removed. Thus, to use the personal emergency breathing system hereof with locator, the cover is removed from the canister. This enables the nose cone to automatically move under the spring bias from its first recessed position to a fully extended or projected position, preferably beyond the end confines of the collar and canister. In that position, the tapered surface of the nose cone may engage the rim of the annular fitting on the face mask or supplied air hose portion. By movement of the canister toward the face mask or supplied air hose portion fitting with the nose cone guiding such movement, the canister and/or fitting can be relatively moved into final securement with one another. In that position, breathable ambient air is supplied through the filtration unit and the apertures of the nose cone to the user.

In another aspect of the present invention, there is provided a shock mounting for the filtration unit within the canister. It will be appreciated that the following description of the shock mounting has applicability to the foregoing-described personal emergency breathing system with locator for use with supplied air respirators, as well as more generally to personal emergency breathing systems such as illustrated in my prior U.S. Pat. No. 5,315,987. In order to shock-mount the filtration unit within the canister, an annular gasket formed of resilient flexible material such as silicone or rubber is provided about the margin of an upper end of the filtration unit. In one form of the gasket, its sides have a convex surface which mates with a complementary concave surface formed about the interior of the canister. The gasket also has an annular end face for abutting a complementary end face of the canister body. Consequently, the gasket mounts the filtration unit at an upper end within the canister body in a manner maintaining the filtration unit centered with the gasket absorbing axial and radial displacements of the filtration unit.

In another form of the gasket, a generally annular, preferably rubber gasket is disposed between an upper annular interior portion or ring of the canister and the upper end of the filtration unit. The gasket is folded inwardly intermediate its ends to form an axially and radially shock-absorbing member which maintains the filtration unit in position within the canister out of contact with the walls of the canister which simultaneously permits limited movement of the filtration unit axially and radially relative to the canister in a manner resistant to shocks and absorbing those displacements.

To shock-mount the lower end of the filtration unit in the canister body, the filtration unit has a plurality of circumferentially spaced radially inwardly directed flexible resilient legs which project from the filtration unit for bearing engagement against the interior bottom end face of the canister body. The areas of contact between the legs and the end face of the canister are surrounded by a locating ring which maintains the legs within the ring. All other exterior surfaces of the filtration unit are spaced from the interior surfaces of the canister body. Consequently, the filtration unit is mounted for flexible resilient connection within the canister at only two locations, i.e., the gasket and the legs. By tapering the legs inwardly toward the axis of the canister and providing the gasket with a concave portion laterally of the canister, the gasket and legs are able to absorb relative movements between the canister body and filtration unit in axial and radial directions while maintaining the filtration unit centered in the canister.

In another form of shock mounting for the lower end of the filtration unit in the canister body, the shock mount may include a generally cup-shaped element, preferably formed of a plastic such as polycarbonate, having an annular upper rim engaging the lower portion of the filtration unit and a plurality of spring legs engaging a reduced annular base which engages against the base of the canister. The legs are shaped to form a series of U-shaped portions whereby the filtration unit is supported by the shock mount at the lower end of the canister for flexible resilient movement in axial and radial directions without contact of the filtration unit against the walls of the canister. The legs define substantially large openings between adjacent legs to enable the flow of ambient air between the legs and into the filtration unit.

In a preferred embodiment according to the present invention, there is provided a personal emergency breathing system for attachment to a fitting of a supplied air respiratory system having a gas mask, comprising a canister having an opening and a closure removably carried by the canister for closing the opening, the canister including an air passage in communication with the opening for receiving ambient air upon removal of the closure, an air filtration unit within the canister and containing air filtering material for filtering ambient air received through the opening and the air passage when the closure is removed, a collar carried by the canister and defining a filtered air outlet passage in communication with the air filtration unit for receiving filtered air therefrom, the collar being adapted for securement to a fitting carried by the supplied air respiratory system for securing the canister to the fitting whereby filtered air may be transmitted from the canister through the collar and the filter air outlet passage into the gas mask and a locator carried by the canister for centering the collar and the fitting relative to one another as the collar and fitting are relatively displaced toward one another into securement.

In a further preferred embodiment according to the present invention, there is provided a personal emergency breathing system comprising a canister having an opening and a closure removably carried by the canister for closing the opening, the canister including an air passage in communication with the opening for receiving ambient air upon opening the closure, an air filtration unit within the canister and containing air filtering material for filtering ambient air received through the opening and the air passage when the closure is opened and shock-absorbing members disposed between the air filtration unit and the canister for substantially isolating the filtration unit from loadings applied to the canister.

In a still further preferred embodiment according to the present invention, there is provided a method of supplying breathable air in a personal emergency breathing system, including a gas mask for overlying a user's face, a respiratory air supply system having a tank of breathable air and an air hose normally connected between the tank and the face mask for supplying breathable air from the tank through the air hose to the gas mask and a normally closed canister containing an air filtration unit for filtering ambient air, comprising the steps of disconnecting the respiratory air supply from the face mask, opening the normally closed canister to provide ambient air to the filtration unit, guiding the canister relative to a fitting carried by one of the gas mask and the air hose from a first position of initial contact therewith by guiding the canister along guide surfaces formed along the canister and the fitting into a second position fully seated on the fitting and connecting the canister to the fitting in the second position of the canister for supplying ambient air through the filtration unit through the fitting to the gas mask.

Accordingly, it is a primary object of the present invention to provide a novel and improved personal emergency breathing system having a locator for quickly and accurately enabling connection between the filtration system and the face mask or air hose portion of a supplied air respiratory system when the latter system fails or its supply of air is exhausted. It is also an object of the present invention to provide a shock mounting for the filtration unit of a personal emergency breathing system to thereby minimize or eliminate the effects of vibration, shock or rough handling of the canister on the filtration materials of the filtration unit.

BEST MODE FOR CARRYING OUT THE INVENTION

Figure 2B:
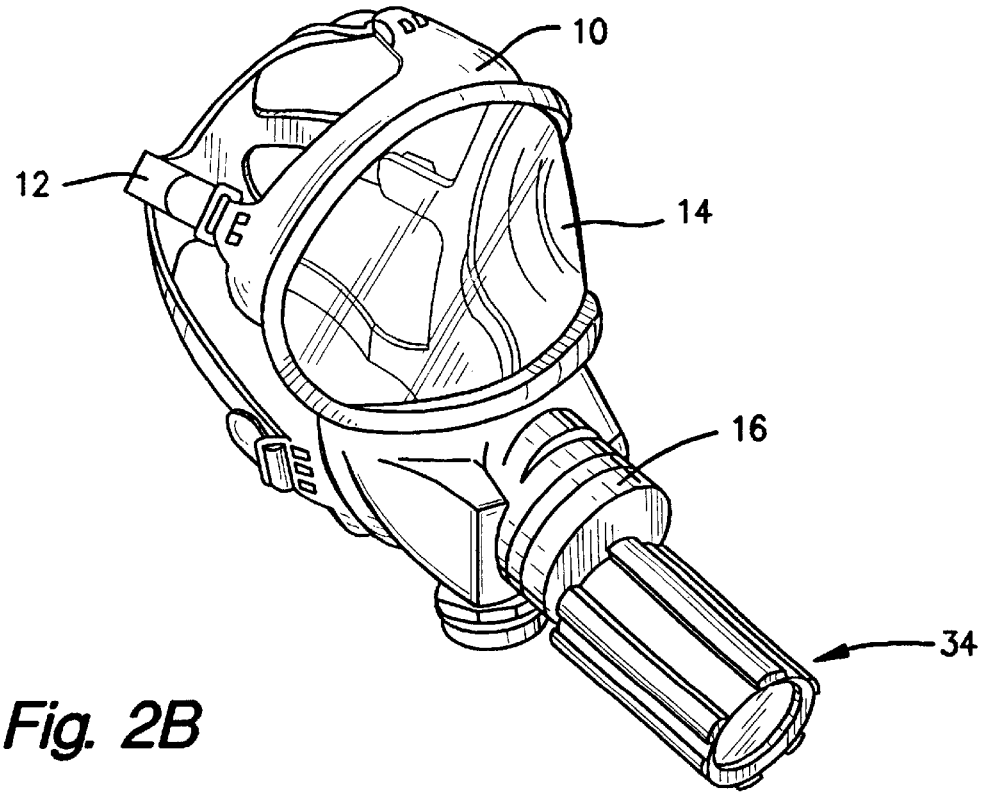
FIG. 2B is a similar view of the gas mask illustrating a canister coupled to the gas mask for supplying filtered ambient air to the user in accordance with the present invention.
Figure 2A:
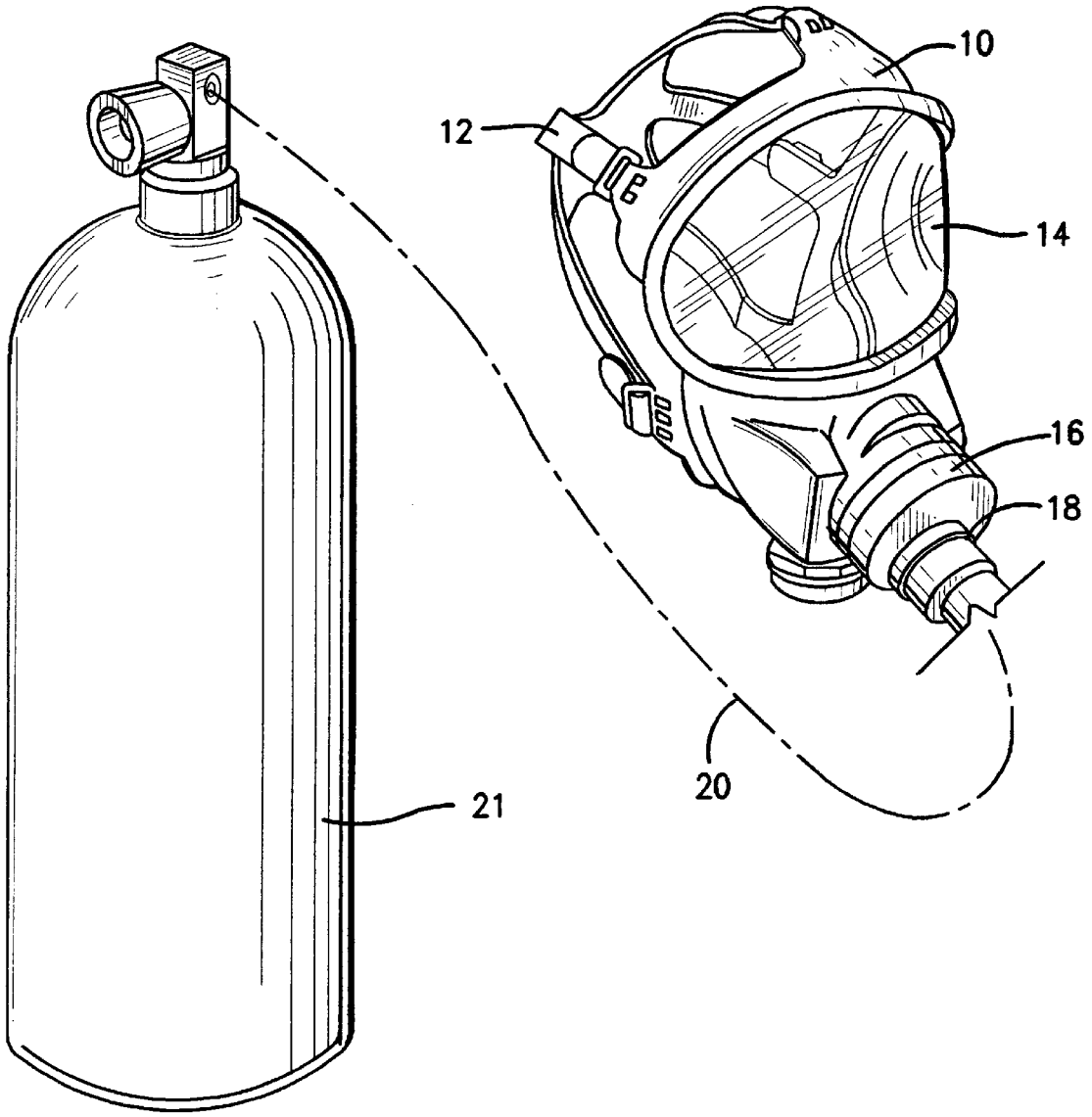
Fig. 2A PRIOR ART
FIG. 2A is a schematic perspective view of the supplied air respiratory system including a gas mask coupled to an air tank.
Figure 4:
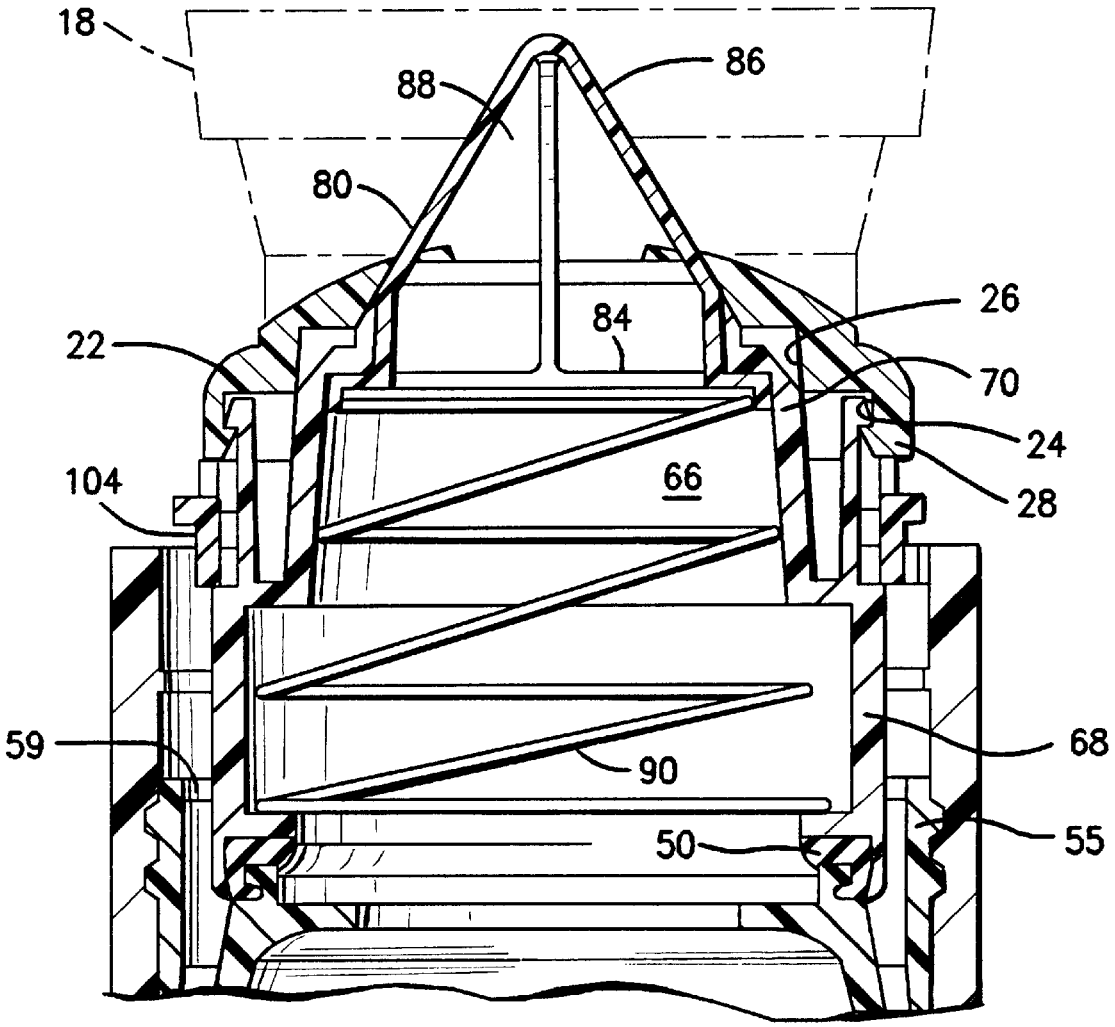
FIG. 4 is a fragmentary cross sectional view of an upper portion of the canister with the cover removed and the locator in position for guiding the canister toward connection with the gas mask fitting.

Referring now to the drawings, particularly to FIGS. 2A and 2B, there is illustrated a typical supplied air respiratory system including a gas mask 10 having straps 12 releasably securing the mask 10 to a user's face, a face plate 14, and a valve mechanism 16 including a fitting 18 for releasably securing the regulator of an air supply system coupled to a hose 20 for supplying air from a tank 21 to the face mask. The face mask, regulator and air supply tank are conventional in construction. It will be appreciated that the gas mask fitting 18 is provided with a quick connect/disconnect for coupling the regulator and hose to the mask 10, e.g., as illustrated in FIG. 4. Fitting 18 preferably includes an annular 20 sleeve 22 having an internal annular groove 24 within an air passage 26 of the fitting and an annular flange 28 at the end of the fitting.

Figure 1:
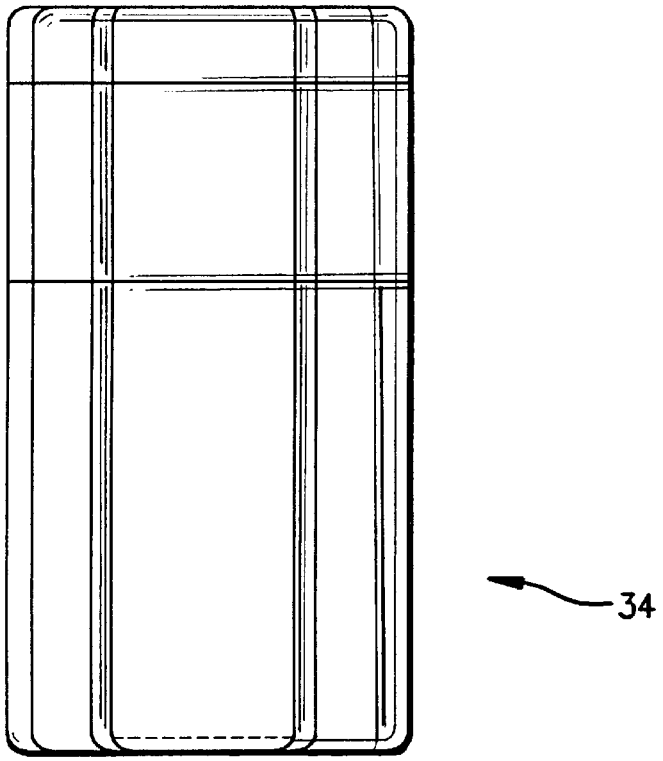
FIG. 1 is a side elevational view of a canister for use with a supplied air respiratory system according to a first embodiment of the present invention.
Figure 2C:
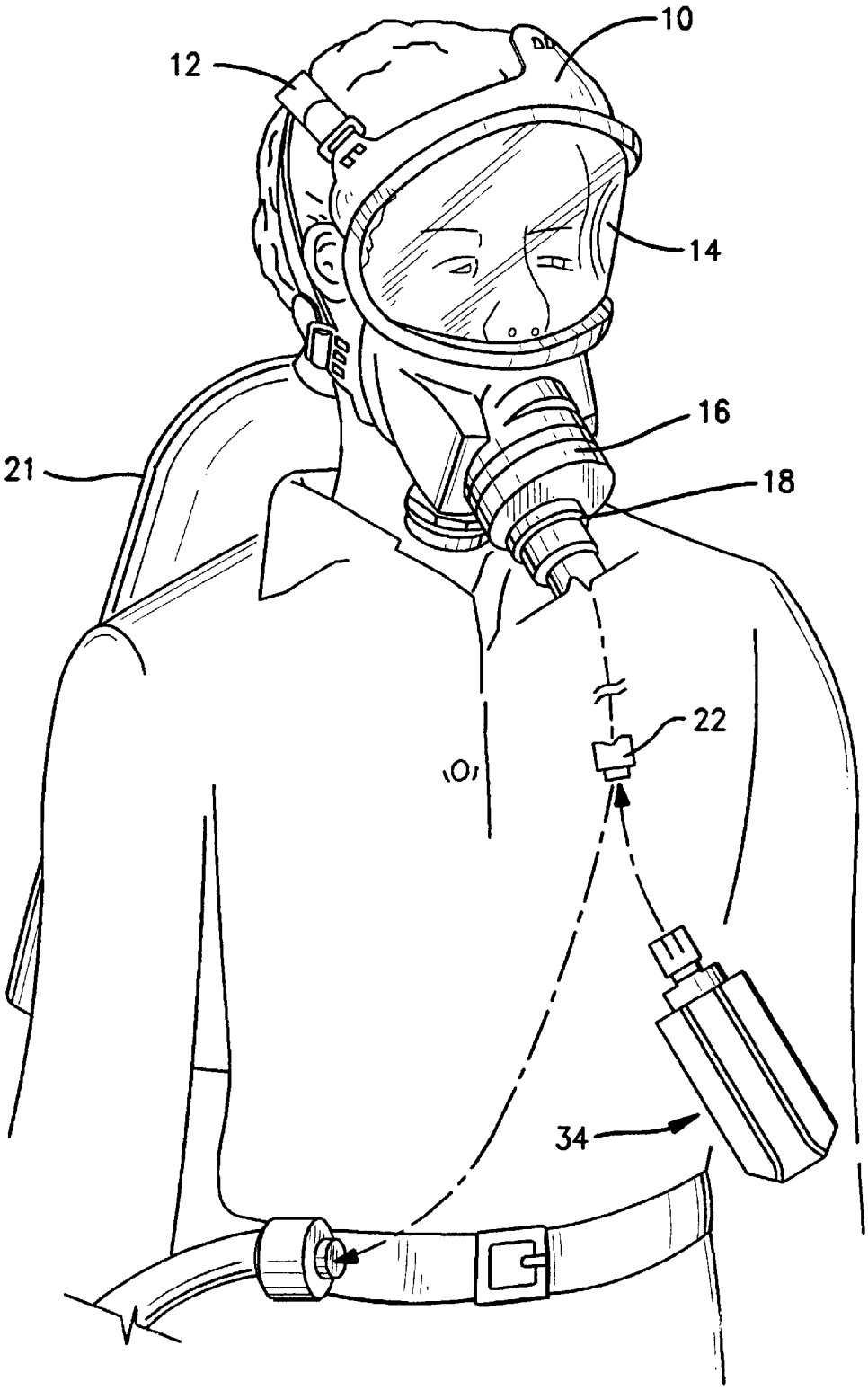
FIG. 2C is a similar view illustrating the canister coupled to a delivery hose from the regulator.
Figure 3:
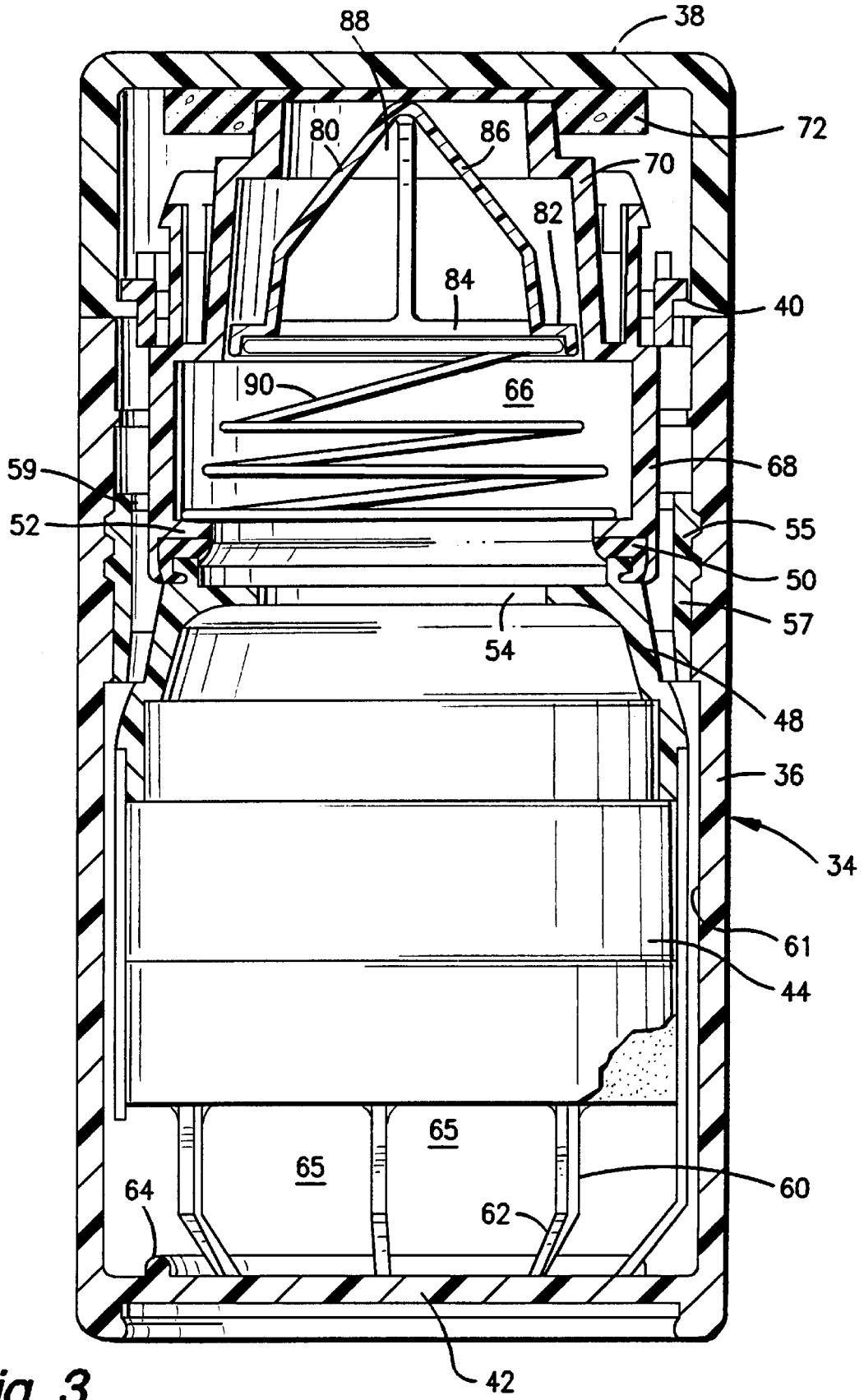
FIG. 3 is an enlarged cross sectional view of the canister in a closed condition prior to use with the supplied air respiratory system.

Referring to FIGS. 1 and 3, there is illustrated a canister constructed in accordance with the present invention for releasable coupling to the fitting of the gas mask upon disconnection of the regulator and air hose from the mask to supply filtered ambient air to the user. The canister, generally designated 34, is supplied in a closed configuration for carrying by the user of the supplied air respiratory system, for example, on a belt carrying the user's equipment. Consequently, when the user's air supply, for example, from tank 21 is exhausted or when the system malfunctions, canister 34 is removed from the belt, the regulator and hose are disconnected from the gas mask fitting 18 and the canister is connected to the gas mask. Alternatively, a fitting may be provided on a portion of the air supply hose 20 forming part of the supplied air system as illustrated in FIG. 2 to supply filtered ambient air to the user. That is, as illustrated in FIG. 2, the delivery hose 20 may have a quick connect/disconnect bottom fitting 22 similar to fitting 18 of the gas mask described above for connection to a regulator sometimes carried on the belt, the regulator forming part of an air supply conduit to the gas mask. Thus, fitting 22 on the air hose 20 may be disconnected from the regulator and the canister connected to the fitting 22 to supply filtered air to the gas mask through the delivery hose. Reference herein to the fitting means therefore either one of the fitting 18 on the mask or the fitting 22 on the supplied air hose 20, unless otherwise specified.

More particularly, and referring to FIG. 3, canister 34 includes a housing or body 36 having a cover 38 releasably secured to the housing 36, for example, by a bayonet-type joint 40. In a preferred form hereof, the canister housing 36 is closed at its bottom end 42. The canister 34 houses a filtration unit 44 containing filter material. For example, the filter unit may comprise an annular sleeve or housing encompassing layers of air filtering material. Particularly, the filtering materials may be arranged in stages, the first stage comprising activated carbon granules, a second stage comprising a desiccant to remove moisture from the inhaled ambient air, e.g., a zeolite type 13x, a third stage for converting carbon monoxide to carbon dioxide for a catalyzation process, for example, a carulite-type 200, a copper manganese oxide hopkalite catalyst; and a fourth, optional stage for converting carbon dioxide to oxygen, e.g., lithium peroxide or other suitable chemicals, preferably a monolithic filter for converting carbon monoxide to carbon dioxide. Use of a monolithic filter will eliminate the need for use of zeolite as a pre-filter but will still retain the use of activated carbon.

Figure 11:
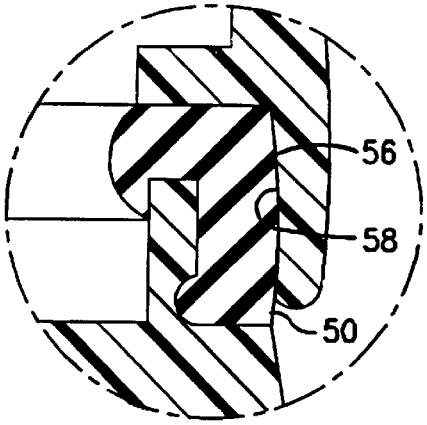
FIG. 11 is an enlarged cross sectional view of the shock mounting at the upper edge of the air filtration unit.

The filtration unit 44 has an upper extension 48, the upper end of which mounts a gasket 50 bearing against a radially inwardly directed annular flange 52 forming part of the housing 36. The extension 48 has a central opening 54 through which filtered ambient air is received from the filter material within filtration unit 44 for flow outwardly of the canister to the face mask. The gasket 50 forms part of a shock resistant mounting for the air filtration unit 44 within the canister 34. As illustrated in FIG. 11, gasket 50 includes a flat annular surface for bearing against the underside of the flange 52. Gasket 50 also has a convex outer side surface 56 for engaging a complementary shaped concave surface 58 of a rib forming part of the extension 48. It will be appreciated that the air filtration unit 44 is mounted coaxially within the cylindrical canister. The gasket 50 thus resiliently absorbs motion of the housing 44 in an axial direction toward rib 52 while the side portions of the gasket 50 absorb lateral motions. The complementary concave and convex surfaces of the rib and gasket respectively maintain the air filtration unit centered and isolated from shocks applied to the canister.

The lower end of the air filtration housing 44 is provided with a plurality of generally axially extending resiliently flexible depending legs 60. The lower portions 62 of legs 60 are canted inwardly to engage the end 42 of body 36 inwardly of an annular upwardly projecting rib 64. By engaging the leg portion 62 against the end of the canister and inwardly of the rib, the air filtration unit is maintained centered on axis relative to the canister body. Axial loading in a downward direction causes the legs to resiliently flex absorbing the loading. Lateral loading also causes the rib 64 to engage the ends of the legs flexing them thereby isolating the filtration unit from lateral loadings. The gasket and the legs constitute the sole connection between the air filtration unit and the canister body. The result is that the air filtration unit 44 is completely isolated from loadings applied to the canister body from any direction.

The flange 52 forms part of an annular ring 55 having a depending skirt 57 press-fit to the inside of housing body 36, securing the gasket 50 relative to the body 36. As illustrated, a plurality of openings 59 are provided through the ring 55 for supplying ambient air, when cover 38 is removed, into the annular space 61 between the air filtration unit 44 and the interior surface of canister body 36 for flow into the volume 65 between the lower end of filtration unit 44 and the end 42 of canister 34. Thus, when the canister is open, i.e., cover 38 is removed, ambient air may flow through the open end of the canister, through openings 59 into the annular space 61 about the air filtration unit 44 and into the volume 65 for flow through filtration unit 44 and into an outlet passage 66 defined within inner and outer sleeves 68 and 70 of ring 57. As illustrated, the outer sleeve 70 projects upwardly beyond the upper end of inner sleeve 68 and is stepped radially inwardly. The underside of the closure or cover 38 carries a seal, for example, a closed cell foam or soft rubber/polymer seal 72 which seals about the end of inner sleeve 70 when the cover is applied to the canister housing 36. A suitable seal, for example, an O-ring seal, may be provided about the margin of the cover 38 and body 36, thus completely sealing the interior of the housing and particularly the filtration unit 34.

It is a significant feature of the present invention that there is provided within the canister 34 a locator for guiding the canister relative to the fitting 18 or 22 to facilitate a quick connect securement between the canister and the fitting. That is, the canister is provided with a locator which guides the relative movement of the canister and fitting upon initial contact therebetween into final securement to one another. To that end, there is provided within the outer sleeve 70 a nose cone 80. Cone 80 includes an annular base 82 defining an opening 84 with a plurality of upwardly extending, inwardly tapered struts 86, defining apertures 88 therebetween. A helical coil spring 90 has a lower end seated along the upper surface of flange 52 and an upper end engaged along the underside of the base 82 of the nose cone 80. Spring 90 thus biases the nose cone 80 for movement in an axial direction outwardly of the canister body. The nose cone is maintained in the canister body in a first or innermost position by engagement of its nose against the underside of closure or cover 38. It will be appreciated that upon removal of cover 38, spring 90 displaces the nose cone 80 outwardly until the base 82 engages an annular undersurface 90 formed on the outer sleeve 70. In that second position of the nose cone, it will be appreciated that the cone projects outwardly of the canister body as illustrated in FIG. 4.

Figure 5:
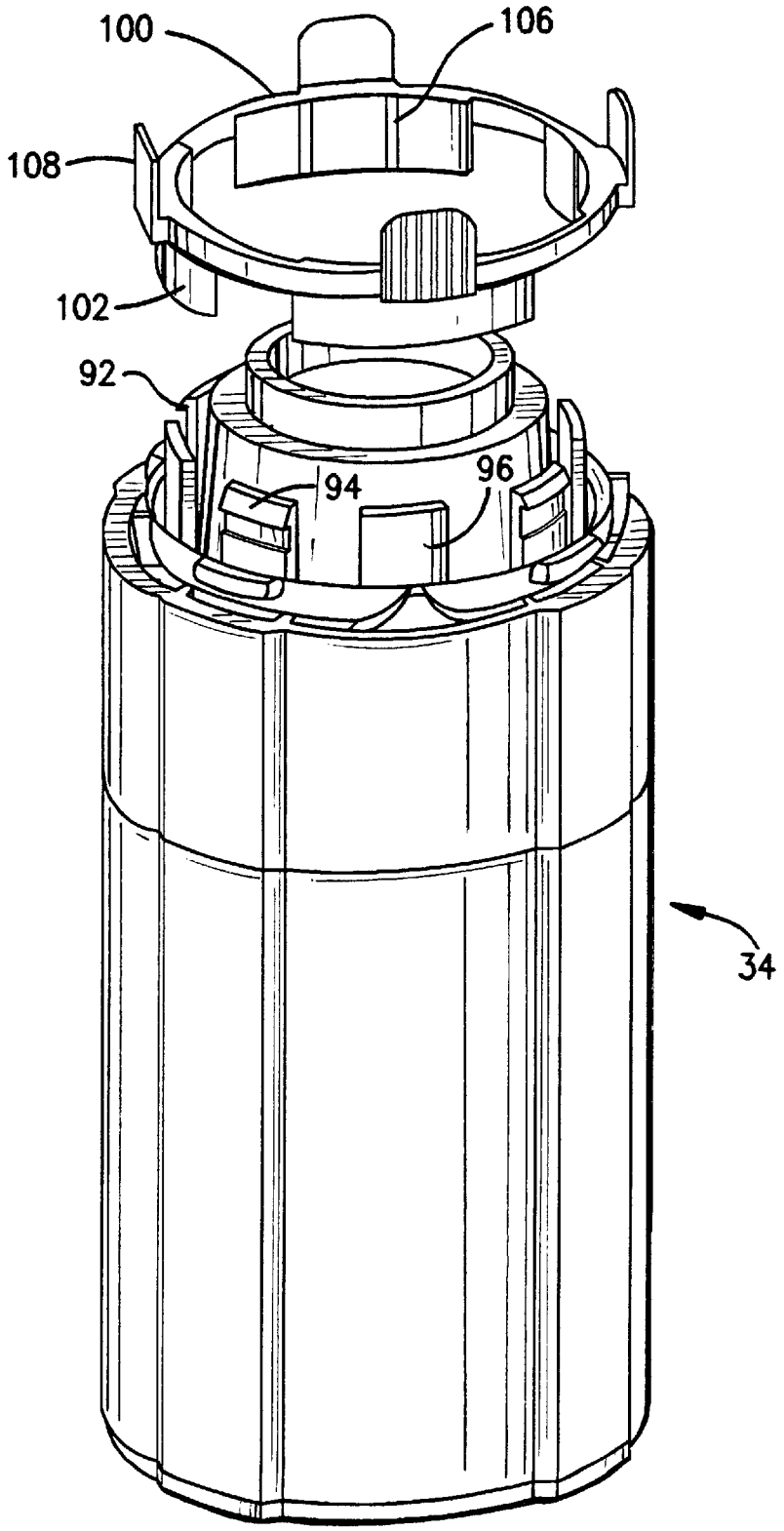
FIG. 5 is a perspective view of the canister and unlocking ring.

To facilitate connection between the canister body and the fitting 18 or 22, the ring 55 is provided with a plurality of circumferentially spaced, upstanding projections or lugs (FIG. 5) 92 having radially outwardly directed flanges 94 at their outer tips. For example, four such lugs 92 are provided 90° apart from one another about the ring 55. Additional lugs 96 are also provided but which lugs 96 do not have flanges at their distal ends. The outwardly directed flanges 94 of lugs 92 are for engagement in the groove 24 of the fitting 18 or 22. Consequently, it will be appreciated that once the cover is removed from the canister, and the tapered nose cone is projecting from the canister as illustrated in FIG. 4, the tapered outer surfaces of the struts 86 engage marginal portions of the opening of the fitting 18 or 22 and consequently center the canister relative to the fitting as the canister and fitting are displaced relative to one another towards final securement. Thus, by pressing the canister and fitting toward one another, the lugs 92 which have tapered outer surfaces are flexed radially inwardly and resiliently spring back to engage over the flange 28 of fitting 18 or 22 to retain the canister on the fitting.

Figure 6:
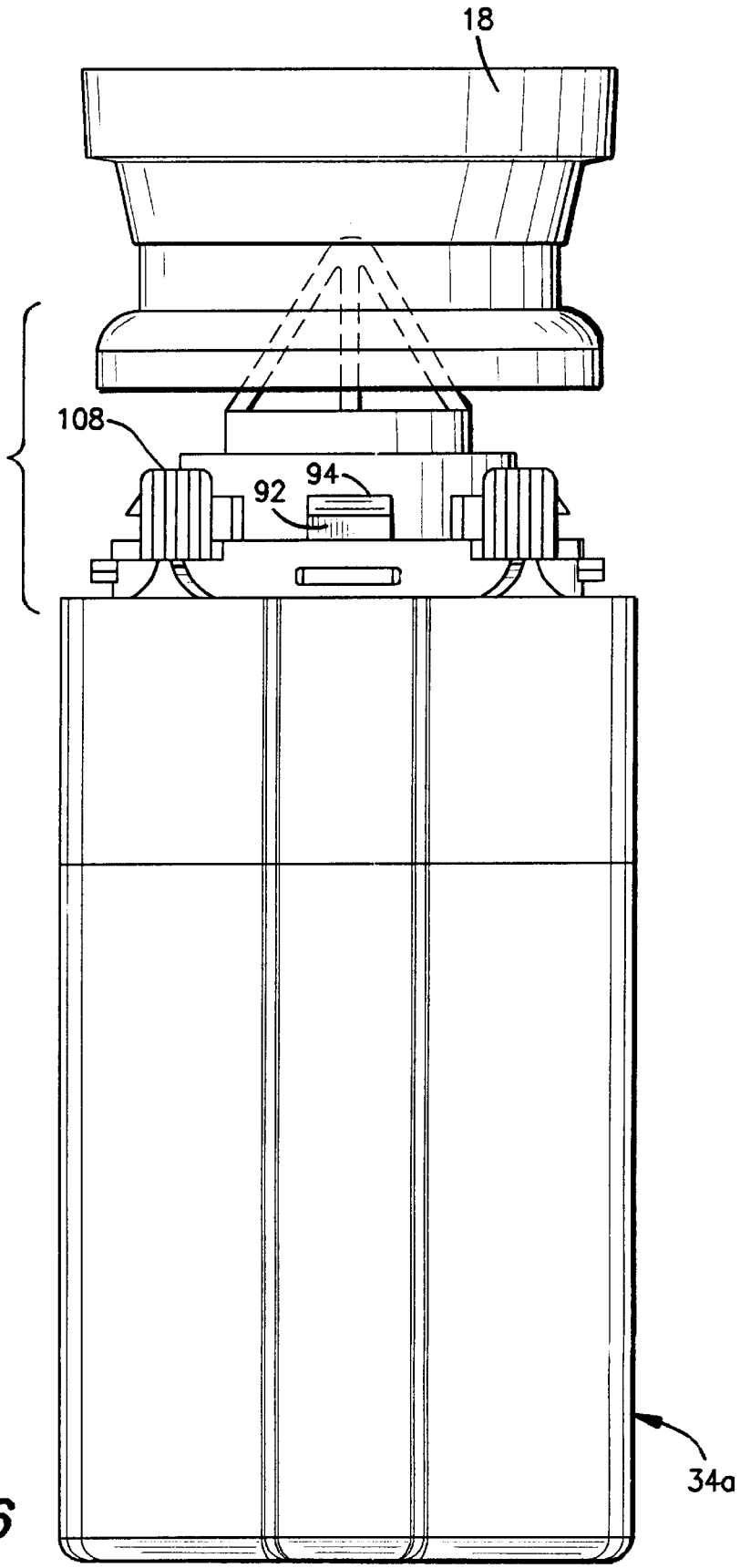
FIG. 6 is a side elevational view illustrating the locator in an extended position guiding the canister toward the fitting of the gas mask.
Figure 7:
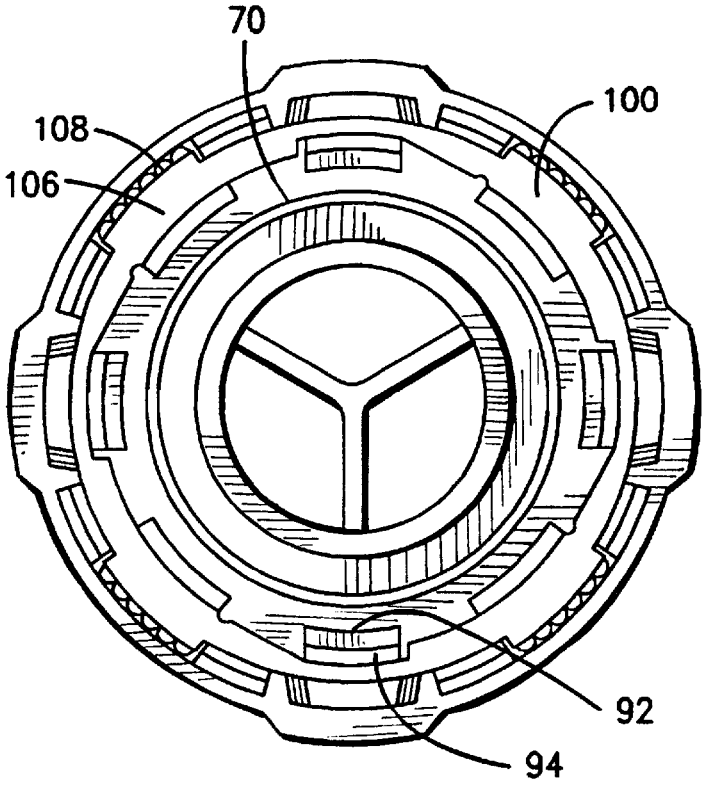
FIG. 7 is a top plan view of the canister with the locator in an extended position.
Figure 8:
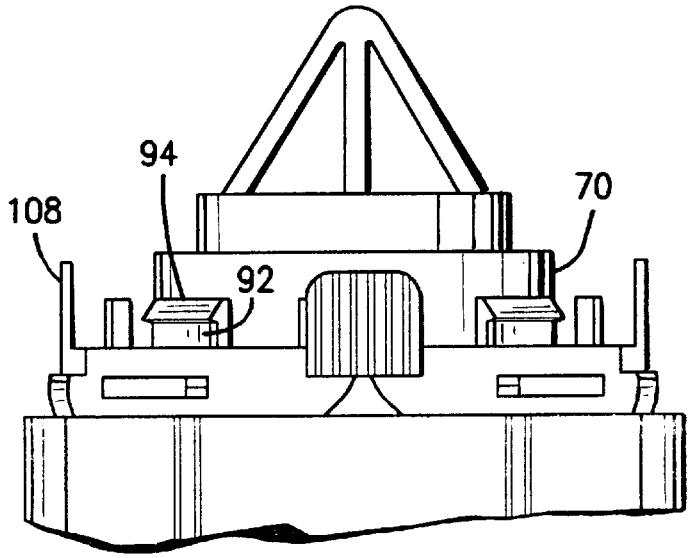
FIG. 8 is a side elevational view of the upper portion of the canister with the release ring in a gas mask fitting release position.

In accordance with another aspect of the present invention, an unlocking ring 100 is provided for releasing the canister from the gas mask fitting after use. The unlocking ring 100 includes a plurality of circumferentially spaced, downwardly extending projections 102 which extend between the upstanding lugs 92 and 96 and the inner margin 104 of the canister body. The ring 100 has radially inward enlargements or projections 106 and upstanding tabs on the outer parts of the projections at circumferentially spaced positions thereabout, for example, 90° apart from one another. As illustrated in FIGS. 6 and 7, the enlargements 106 are circumferentially displaced from the outer surfaces of the lugs 92 enabling the lugs to engage the fitting 18 or 22. With the lugs engaging the fitting and after use, rotation of the ring 100 approximately ⅛ of a turn locates the enlargements 106 into radial registration with the outer surfaces of the lugs causing the lugs to be flexed inwardly. This inward flexing movement displaces the flanges 94 of the lugs from within the groove 24 of the fitting 18 or 22 enabling the canister to be removed from the fitting. The ring then locks and remains in this position and prevents (mechanically) the re-use of the filter. It is prevented from being remounted to the mask aperture. At the same time, "red" (or colored) tabs are exposed, flagging the unit as being used/expired. The upwardly projecting tabs 108 are for purposes of facilitating rotation of the ring 100 between the secured position and the release position.

In using the device as illustrated, in the event the supplied air respiratory system fails or the air supply is exhausted, the user may disconnect the regulator hose from the fitting. The canister may then be opened by removing the cover 38, enabling the tapered nose cone to spring into its second extended position. It will be appreciated that by removing the cover, the air openings 55 are uncovered, enabling ambient air to flow into the canister and through the filtration unit as previously explained. By applying the canister to the fitting, particularly engaging the nose cone against the sides of the opening of the fitting, the engaged sides of the nose cone provide guides enabling the canister and fitting to be guided toward one another into axially coincident positions. As this occurs, the further movement of the canister and fitting toward one another finally seats the canister and the fitting, the connection between the lugs 92 of the canister and the groove 24 of the fitting being automatically attained. Thus, it will be appreciated that the canister is guided into its final securement with the gas mask fitting whether directly on the face mask or on the hose notwithstanding the inability of the user to see the canister or fitting and enabling securement essentially by guiding the canister toward the fitting. It will also be appreciated that, with the canister secured to the fitting and the tapered nose cone projecting into the opening of the fitting, filtered ambient air flows through the outlet passage 66, past the apertures 88 of the nose cone into the face mask. After use, the canister may be released from the fitting by rotating the unlocking ring 100 approximately ⅛ of a turn. This causes enlargements 106 to flex the lugs 92 inwardly to remove the flanges 94 from the groove 24, enabling the canister to be removed from the fitting. The locking ring 106 then remains in position, preventing re-use of the filter and the indicators, i.e., colored tabs are exposed, flagging the unit as being used or expired.

Figure 9:
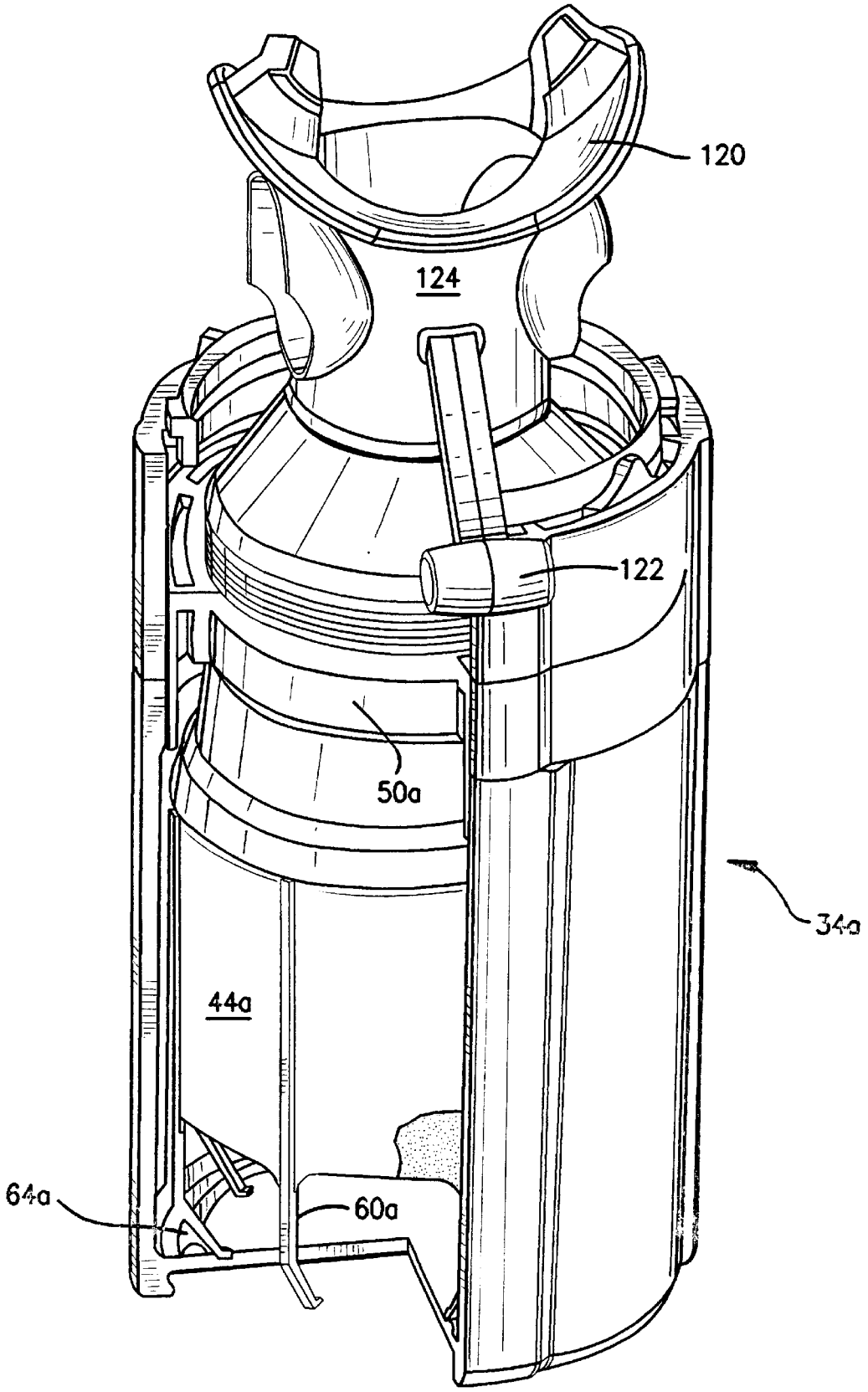
FIG. 9 is a fragmentary perspective view of a further form of canister illustrating a shock resistant mounting for the air filtration unit in a canister for use in a personal emergency breathing system.
Figure 10:
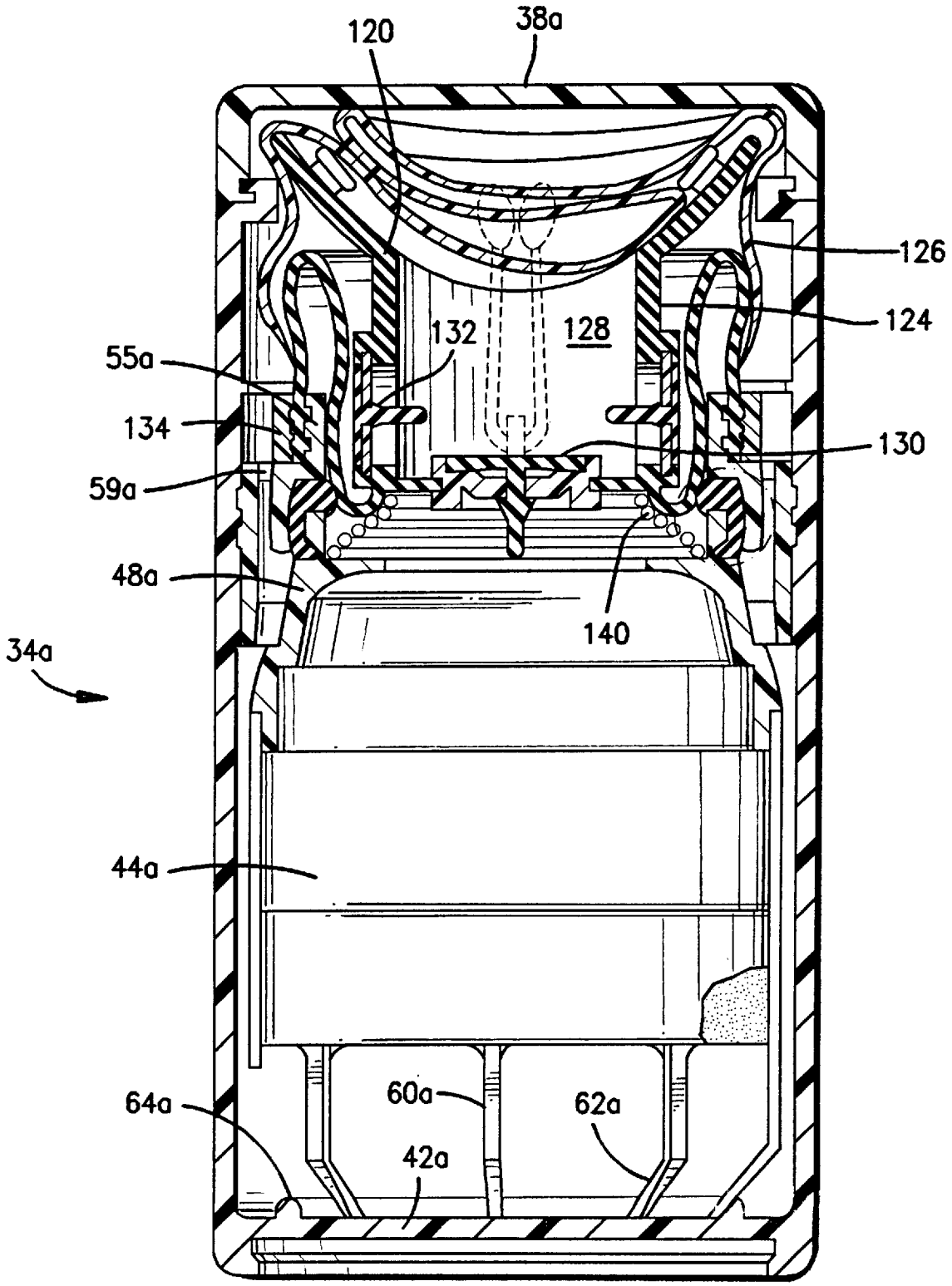
FIG. 10 is a cross sectional view of the canister of FIG. 9 illustrated in a closed position.
Figure 12:
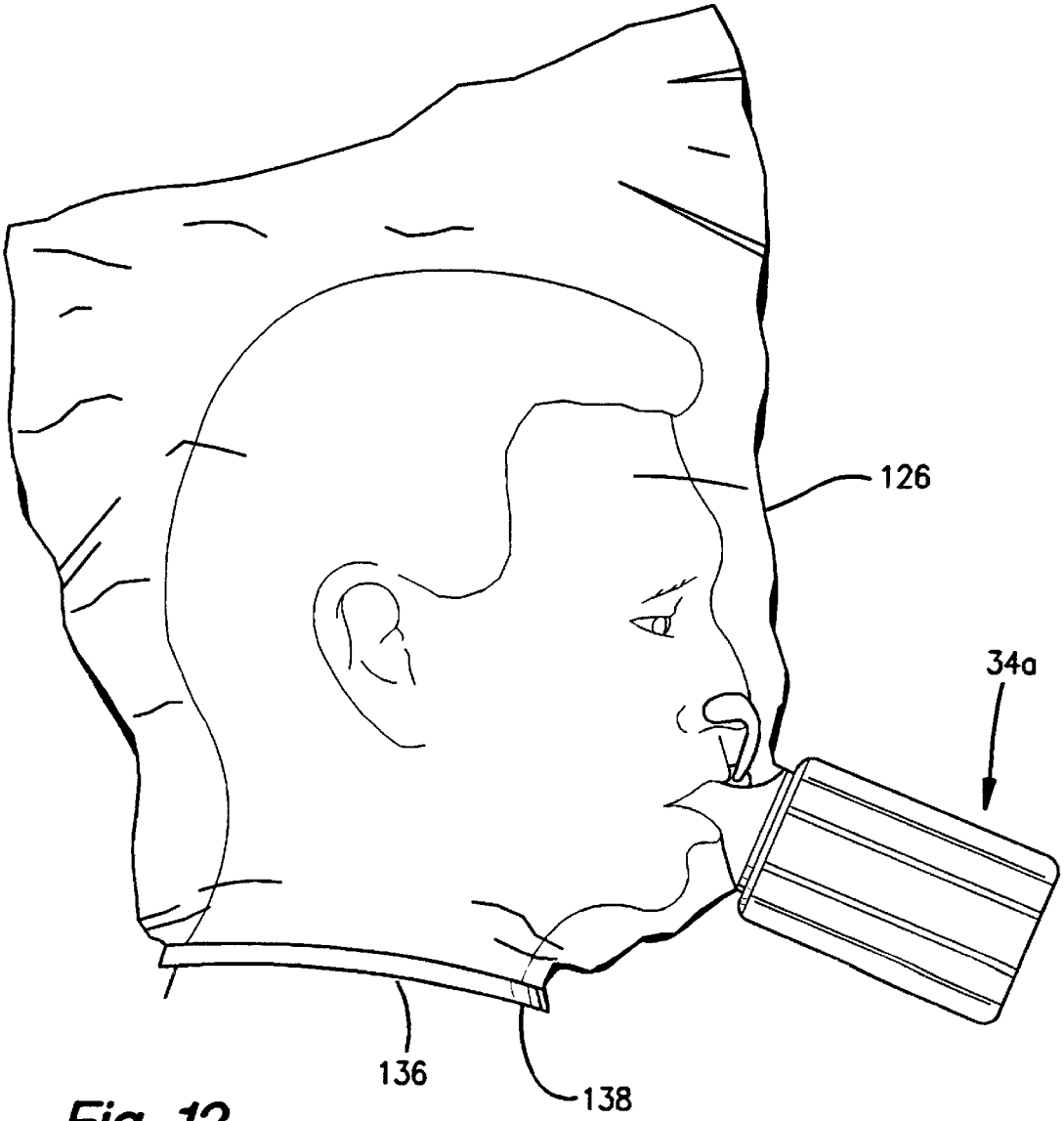
FIG. 12 is a schematic side elevational view of the canister of the personal emergency breathing system of FIGS. 9–11 in a deployed condition.

Referring now to an embodiment illustrated in FIGS. 9–12 wherein like reference numerals refer to like parts, followed by the suffix "a," the previously described shock resistant mounting may be employed in a different form of canister, i.e., in the form of a canister described and illustrated in my prior U.S. Pat. No. 5,315,987, the disclosure of which is incorporated herein by reference. In that system, there is provided with the canister 34*a* a mouthpiece 120 having a nose clip 122, a flexible resilient plenum 124 for conveying ambient filtered air from the filtration unit 44*a* to the mouthpiece 120, and a hood 126. As illustrated, the air filtration unit 44*a* is mounted in canister 34*a* similarly as previously described in the first embodiment hereof. Referring to FIGS. 9 and 10, the plenum 124 and mouthpiece 120 define an air passage 128 which communicates with the filtered ambient air flowing through the air filtration unit 44*a* when cover 38*a* is removed by way of an inhalation one-way check valve 130. A pair of exhalation one-way check valves 132 are provided on opposite sides of the plenum inside the hood 126. Margins of the hood 126 are clamped between a ring 134 and the ring 55*a* forming part of the canister and opening 136 is formed through another portion of the hood 126 and has a drawstring 138 for loosely tightening the neck portion of hood 126 or opening 136 about an individual's neck, as illustrated in FIG. 12. The hood 126 may be formed of a clear, heat-resistant plastic material such as Kapton and may be coated with a layer of titanium in accordance with U.S. Pat. No. 5,133,527.

As illustrated in FIG. 10, the plenum is secured between the canister ring 55*a* and the clamp ring 134. A helical coil spring 140 engages between the flange of the filter unit 48*a* and an inside annular surface surrounding the inhalation valve 130 of the plenum 120. As illustrated in FIG. 10, the plenum 120, together with the inhalation and exhalation valves 130 and 132, respectively, as well as the hood, are maintained within the canister 34*a* against the bias of spring 140 when the cover 38*a* is secured to the canister. Consequently, when the cover 38*a* is removed, the plenum 120, including the mouthpiece and valves and the hood are projected from the canister body into a deployed position, as illustrated in FIGS. 9 and 12 (the hood being omitted from FIG. 9 for clarity). The lower end of air filtration housing 44*a* is provided with resiliently flexible legs 60*a*, having inwardly canted lower portions 62*a* engageable against a rib 64*a*.

In the event of a fire requiring immediate exit from a smoke-filled or toxic fume-filled area, cover 38*a* is removed from the canister body by rotating it in either direction. Once removed, the hood 126 and plenum 124, including mouthpiece 120, automatically deploy through the open end of the canister 34*a*. The rubber mouthpiece and plenum extend from their folded position as a consequence of their elastic memory when the cap or cover 38*a* is removed with the assistance of spring 140. By removal of the cap, it will be appreciated that the air openings 59*a* are exposed to the ambient air whereby air is supplied into the filtration unit 44*a* as previously described. After the cover has been removed, the user draws the hood 126 over his/her head through opening 136, with the elasticized band or drawtape 138 forming a substantial, but not air-tight, seal about the individual's neck. Because the mouthpiece projects from the open end of the canister, the user can readily insert the mouthpiece 120 into his/her mouth and apply the nosepiece about the nose, with all breathing being conducted through the user's mouth.

Upon inhalation, filtered ambient air passes through the filtration unit 44*a* through the inhalation valve 130 into the air passage 128. Upon exhalation, the positive pressure generated by exhalation closes the inhalation valve 130 and opens the exhalation valves 132 whereby exhaled air flows into the interior of the hood. Thus, a positive pressure is maintained within the hood, maintaining the body of the hood away from the individual's face, as well as preventing ambient air which may have smoke or toxic fumes contained therein from entering the interior of the hood through any air leakage paths between the drawtape 138 and the individual's neck.

Figure 13:
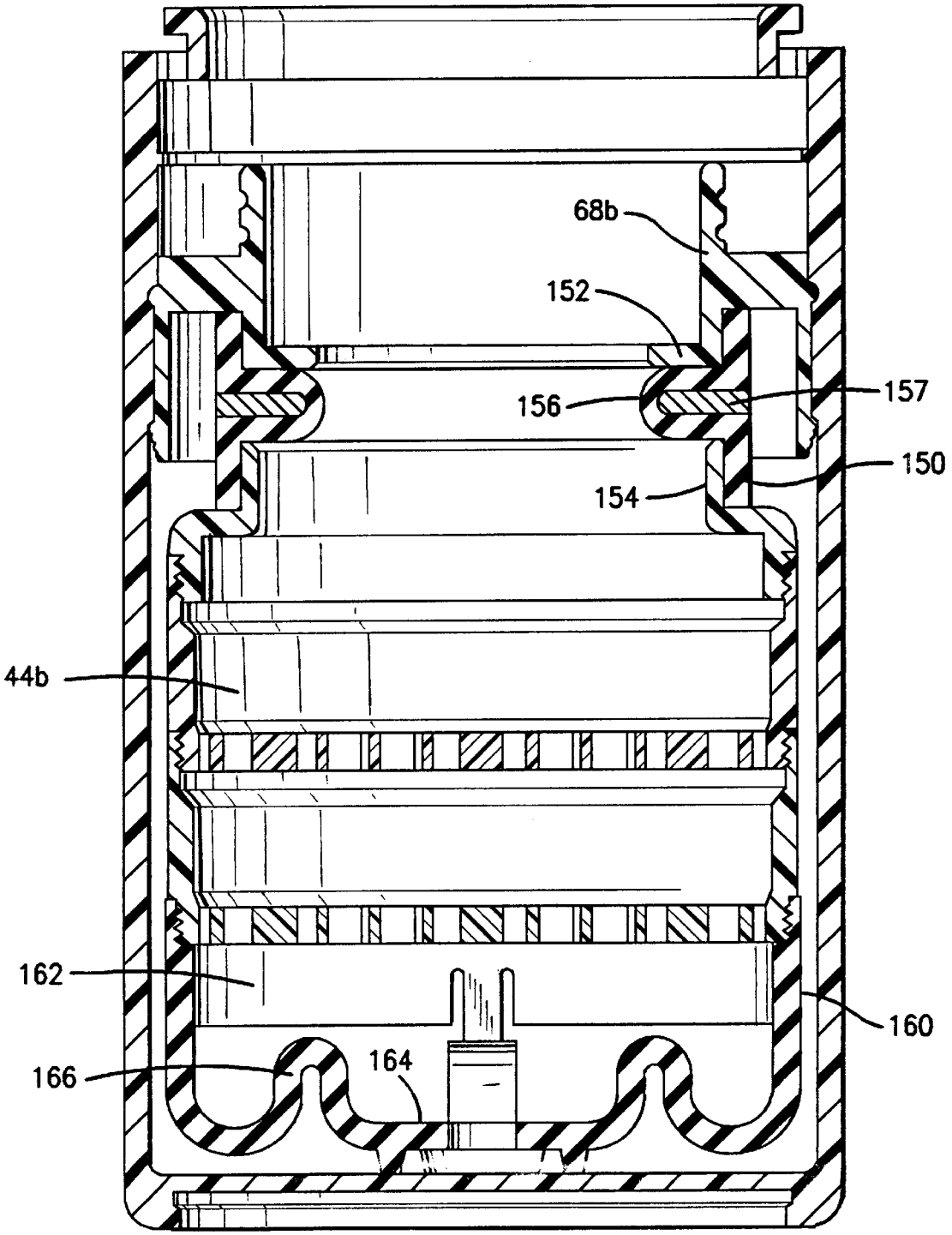
FIG. 13 is a view similar to FIG. 3, without the cover or the locator within the housing, illustrating another form of shock mounting for the filtration unit within the canister.
Figure 14:
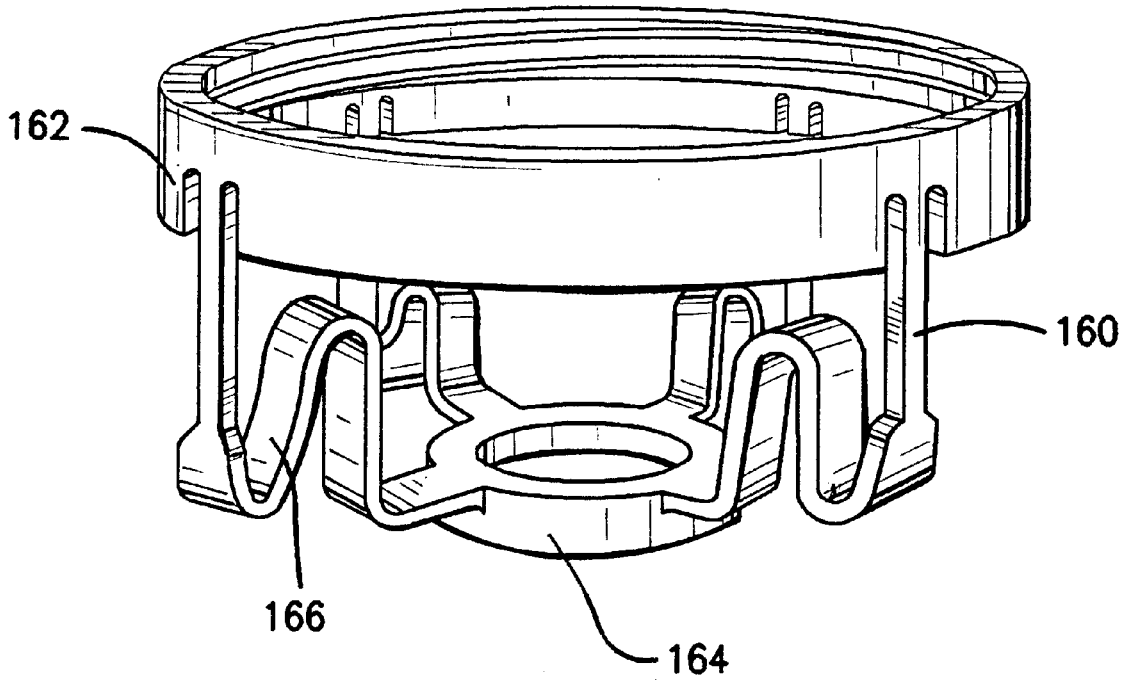
FIG. 14 is a perspective view of the shock mount at the lower end of the air filtration unit.

Referring to FIGS. 13 and 14, there is illustrated a further form of a shock mount for the filtration unit relative to the canister wherein like parts are referenced by like numerals as in preceding embodiments, followed by the suffix "b." In this form, there is provided an annular gasket 150 which is secured at its upper end about a depending shoulder 152 of the sleeve 68*b* secured to the canister. The lower end of the annular gasket 150 is secured about an upstanding shoulder 154 forming part of the filtration unit 44*b*. The gasket 150 is preferably formed of rubber and has an intermediate portion 156 folded radially inwardly to lie between the sleeve 68*b* and rim 154. As illustrated, the lower end of the sleeve 68*b* is spaced axially from the rim 154, with the intermediate portion 156 of the gasket 150 lying therebetween. Consequently, it will be appreciated that the resilient but flexibly deformable gasket 150 maintains the upper end of the filtration unit spaced from the sleeve 68*b* and the canister walls by its inherent elasticity, thereby affording a shock-resistant mounting for the upper end of the filtration unit relative to the canister.

In a preferred form, radial bracing membranes 157 of a rigid annularly segmented material may be disposed between the folds of the gasket 150 or its radially outer side. The membranes 157 add resistance to longitudinal axial shocks and lateral shock loads.

The lower end of the filtration unit is provided with a shock mounting 160. The shock mount 160 may be formed of a plastic material such as polycarbonate and comprises an upper rim 162 for engaging about the lower end of the filtration unit 44*b* and an annular base 164. The base 164 and rim 162 are interconnected by a plurality of flexible resilient legs 166, four legs being preferred, although fewer or more legs may be accommodated. Each leg has a pair of reverse bends wherein the legs form interconnected U-shaped portions affording a resiliency and flexibility between the base 164 and rim 162. With the shock mount 160 disposed between the lower end of the filtration unit 44*b* and the base of the canister, it will be appreciated that the legs 166 resiliently and elastically maintain the filtration unit centered with respect to the canister, spaced from the walls of the canister and afford a shock mount for the air filtration unit. The spaces between the legs enable the air flowing through the canister as previously described to flow between the legs and into the openings at the lower portion of the air filtration unit 44*b*. It will be appreciated that the shock mounts at the upper ends of the filtration units of FIGS. 10 and 13 may be interchanged with one another for use with the respective shock mounts at the lower ends of the filtration units of those drawing figures. Also, it is important that the reaction of the upper rubber shock absorbing collar and the lower polycarbonate legs 166 of the shock absorbing mount 160 are compatible in their shock absorbing function so that one does not overwhelm the other.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system for attachment to a fitting of a supplied air respiratory system having a gas mask, comprising:

a canister having an opening and a closure removably carried by said canister for closing said opening, said canister including an air passage in communication with said opening for receiving ambient air upon removal of said closure;

an air filtration unit within said canister and containing air filtering material for filtering ambient air received through said opening and said air passage when said closure is removed;

a collar carried by said canister and defining a filtered air outlet passage in communication with said air filtration unit for receiving filtered air therefrom, said collar being adapted for securement to a fitting carried by the supplied air respiratory system for securing the canister to the fitting whereby filtered air may be transmitted from the canister through said collar and said filtered air outlet passage into the gas mask; and a locator carried by said canister for centering the collar and the fitting relative to one another as the collar and fitting are relatively displaced toward one another into said securement;

said locator being mounted within said canister for movement between a first position within said canister when said canister is closed by said closure and a second position enabled for guiding the collar of said canister relative to the fitting when the canister is secured to the fitting.

2. A system according to claim 1 wherein said canister has a longitudinal axis and said locator is mounted for movement relative to the canister in an axial direction for projection from the canister into said second position thereof.

3. A system according to claim 2 including an element biasing said locator for movement from said first position to said second position, said locator being retained in said first position by said closure and responsive to removal of said closure from said opening for movement into said second position under the bias of said element.

4. A system according to claim 3 wherein said locator is disposed in said filtered air outlet passage and includes at least one opening therethrough for transmitting filtered air from the filtration unit to the gas mask when said canister is secured to the fitting.

5. A personal emergency breathing system for attachment to a fitting of a supplied air respiratory system having a gas mask, comprising:

a canister having an opening and a closure removably carried by said canister for closing said opening, said canister including an air passage in communication with said opening for receiving ambient air upon removal of said closure;

an air filtration unit within said canister and containing air filtering material for filtering ambient air received through said opening and said air passage when said closure is removed;

a collar carried by said canister and defining a filtered air outlet passage in communication with said air filtration unit for receiving filtered air therefrom, said collar being adapted for securement to a fitting carried by the supplied air respiratory system for securing the canister to the fitting whereby filtered air may be transmitted from the canister through said collar and said filtered air outlet passage into the gas mask;

a locator carried by said canister for centering the collar and the fitting relative to one another as the collar and fitting are relatively displaced toward one another into said securement; and shock-absorbing members disposed between said filtration unit and said canister for substantially isolating the filtration unit from loadings applied to said canister.

6. A system according to claim 5 wherein one of said shock-absorbing members includes a gasket formed of resilient material disposed between an end portion of said filtration unit and said canister, said gasket having a convex outer surface for engaging a complementary-shaped concave surface formed on said canister.

7. A system according to claim 5 wherein one of said shock-absorbing members includes a gasket formed of resilient material disposed between an end portion of said filtration unit and said canister, said gasket having a convex outer surface for engaging a complementary-shaped concave surface formed on said canister, said gasket having an intermediate portion elastically extending in a radial direction enabling said filtration unit for shock-resistant movement in axial and radial directions.

8. A system according to claim 5 wherein one of said shock absorbing members includes a plurality of resiliently flexible legs extending from an end of said filtration unit to abutments on said canister, said canister having a longitudinal axis, said abutments on said canister and said legs cooperating to center the filtration unit along an axis of said canister.

9. A system according to claim 5 wherein one of said shock-absorbing members includes a shock mount having a plurality of resiliently flexible legs between said canister and said filtration unit for resiliently mounting said filtration unit in said canister.

10. A personal emergency breathing system comprising:

a supplied air respiratory system including a face mask, a tank of respiratory air, a hose coupling the air tank and said face mask to one another and a fitting carried by said supplied air respiratory system in communication with said face mask;

a canister having an opening and a closure removably carried by said canister for closing said opening, said canister including an air passage in communication with said opening for receiving ambient air upon removal of said closure;

an air filtration unit within said canister and containing air filtering material for filtering ambient air received through said opening and said air passage when said closure is removed;

a collar carried by said canister and defining a filtered air outlet passage in communication with said air filtration unit for receiving filtered air therefrom;

said collar being securable to said fitting upon removal of said hose from said fitting for securing the canister to the fitting whereby filtered air may be transmitted from the canister through said collar and said filtered air outlet passage into said face mask; and a locator carried by said canister for centering the collar and the fitting relative to one another as the collar and fitting are relatively displaced toward one another into said securement.

11. A personal emergency breathing system comprising:

a canister having an opening and a closure removably carried by said canister for closing said opening, said canister including an air passage in communication with said opening for receiving ambient air upon opening said closure;

an air filtration unit within said canister and containing air filtering material for filtering ambient air received through said opening and said air passage when said closure is opened; and shock absorbing members disposed between said air filtration unit and said canister for substantially isolating the filtration unit from loadings applied to said canister.

12. A system according to claim 11 wherein one of said shock absorbing members includes a gasket formed of resilient material disposed between an end portion of said filtration unit and said canister, said gasket having a convex outer surface for engaging a complementary shaped concave surface formed on said canister.

13. A system according to claim 11 wherein one of said shock-absorbing members includes a gasket formed of resilient material disposed between an end portion of said filtration unit and said canister, said gasket having a convex outer surface for engaging a complementary-shaped concave surface formed on said canister, said gasket having an intermediate portion elastically extending in a radial direction enabling said filtration unit for shock-resistant movement in axial and radial directions.

14. A system according to claim 11 wherein one of said shock absorbing members includes a plurality of resiliently flexible legs extending from an end of said filtration unit to abutments on said canister, said canister having a longitudinal axis, said abutments on said canister and said legs cooperating to center the filtration unit along the axis of said canister.

15. A system according to claim 11 wherein one of said shock-absorbing members includes a shock mount having a plurality of resiliently flexible legs between said canister and said filtration unit for resiliently mounting said filtration unit in said canister.

16. A system according to claim 14 wherein another of said shock absorbing members includes a gasket formed of resilient material disposed between an end portion of said filtration unit and said canister, said gasket having a convex outer surface for engaging a complementary shaped concave surface formed on said canister.

17. A system according to claim 11 wherein said air filtration unit has an air outlet, a mouthpiece carried by said canister for receiving filtered air from the outlet of said filtration unit, a hood carried by said canister and enveloping said mouthpiece, said mouthpiece and said hood being disposed in a collapsed condition in said canister, said closure comprising a removable cover adjacent one end of said canister, said hood and said mouthpiece being disposed between said cover and said air filtration unit in said canister whereby upon removal of said cover, said hood and mouthpiece are deployable from said canister to a location external to said canister, said hood having an opening for receiving an individual's head and neck.

18. A method of supplying breathable air in a personal emergency breathing system, including a gas mask for overlying a user's face, a respiratory air supply system having a tank of breathable air and an air hose normally connected between said tank and said face mask for supplying breathable air from said tank through said air hose to said gas mask and a normally closed canister containing an air filtration unit for filtering ambient air, comprising the steps of:

disconnecting the respiratory air supply from said face mask;

opening said normally closed canister to provide ambient air to said filtration unit;

guiding said canister relative to a fitting carried by one of said gas mask and said air hose from a first position of initial contact therewith by guiding the canister along guide surfaces formed along said canister and said fitting into a second position fully seated on said fitting; and connecting said canister to said fitting in said second position of said canister for supplying ambient air through said filtration unit through said fitting to said gas mask;

the step of guiding being accomplished by a locator carried by the canister, and including the further step of displacing said locator from a first position within said canister to a second position projecting from said canister to locate said guide surfaces for initial contact with said fitting.

19. A method according to claim 18 wherein the step of opening the canister includes removing a cover from the canister and displacing said locator from said first position into said second position in response to removal of said cover from said canister.

* * * * *